United States Patent [19]

Apri

[11] Patent Number: 4,537,350

[45] Date of Patent: Aug. 27, 1985

[54] SELF-ACTUATING DRINKING FOUNTAIN/FAUCET

[76] Inventor: Edward W. Apri, 998 Lehigh St., Altadena, Calif. 91001

[21] Appl. No.: 508,178

[22] Filed: Jun. 27, 1983

[51] Int. Cl.[3] ..... E03B 9/20

[52] U.S. Cl. ..... 239/25; 239/445; 239/447

[58] Field of Search ..... 239/24, 25, 445, 447; 137/118, 119, 543.15, 859

[56] References Cited

U.S. PATENT DOCUMENTS

| | | | |
|---|---|---|---|
| 1,105,547 | 7/1914 | Coffield | 239/25 |
| 1,387,718 | 8/1921 | Hollaender | 239/25 |
| 2,179,611 | 11/1939 | Brown | 239/445 X |
| 2,320,530 | 6/1943 | Mead | 239/25 |
| 2,524,956 | 10/1950 | Brunetti | 239/25 |

*Primary Examiner*—Andres Kashnikow
*Attorney, Agent, or Firm*—Alan Conrad Rose

[57] ABSTRACT

A Drinking Fountain attachment for a water faucet is automatically turned on when water is supplied at low pressure and low water flow rates. The assembly includes a hollow body portion between an inlet and an outlet, and the fountain outlet is connected to a central portion of the hollow body. A partition with a central opening extends across the hollow body between the outlet and the point of connection to the fountain. Valve arrangements are provided for normally closing the central passage and for opening it when the water pressure and rate of flow exceed predetermined levels. A flexible, resilient membrane or washer forms a normally open valve but is deflected to close off the connection to the fountain at the higher pressure and flow level at which the valve arrangements operate.

10 Claims, 2 Drawing Figures

SELF-ACTUATING DRINKING FOUNTAIN/FAUCET

FIELD OF THE INVENTION

The present invention relates to water fountain attachments for use in combination with water faucets.

BACKGROUND OF THE INVENTION

It has previously been proposed to provide a drinking fountain arrangements in connection with faucets, for example see U.S. Pat. No. 3,325,101 to Mr. C. Cuschers, and U.S. Pat. No. 3,335,957 to Mr. C. A. Jacobson. However, these prior arrangements require the use of a supplemental handle which operates a valve to divert water to the fountain. This additional handle and associated parts increase the cost of the unit substantially. In addition, when a person wishes to drink from the faucet, they must first turn on the main handle to the faucet and then actuate the supplemental drinking fountain handle. Further, unless due care is exercised, the pressure level and flow rate may be so strong that the water from the faucet will spray over the kitchen, bathroom, or other location where the faucet is located.

Accordingly, a principal object of the present invention is to provide a simple and inexpensive assembly as a drinking fountain attachment to a faucet, and having the additional capability of automatically regulating the water pressure and flow rate of the water supplied to the fountain attachment. A collateral object of the invention is the elimination of the need to operate two handles in order to get a drink of water. A third object of the invention is to automatically provide full water flow and water pressure from the faucet when the fountain is not in use.

SUMMARY OF THE INVENTION

In accordance with the present invention, a drinking fountain attachment for a faucet includes a hollow body portion and a centrally located outlet to a drinking fountain, as well as pressure actuated arrangements in the housing above and below the outlet so that at low water pressures and flow rates all of the water is diverted to the drinking fountain, while at higher pressure and flow rates, the outlet to the drinking fountain is shut off automatically, and all of the water flows straight through from the inlet to the outlet.

In accordance with a broader aspect of the invention, the upper pressure actuated arrangement may be dispensed with, and straight-through flow provided when a lower arrangement opens at higher pressure levels and flow rates.

In accordance with a more specific aspect of the invention, the hollow housing portion of the assembly may be provided with a generally centrally located partition having one or more openings therethrough; a spring-biased valve is normally biased to close the opening or openings through the partition; and a flexible washer or resilient membrane which normally allows the flow of low pressure water to the drinking fountain, is deflected to close off the drinking fountain and to direct the flow of water through the hole or holes in the central partition at higher pressures and flow rates.

Other objects, features and advantages of the invention will become apparent from a consideration of the following detailed description and from the accompanying drawings.

DETAILED DESCRIPTION

Figure 1:
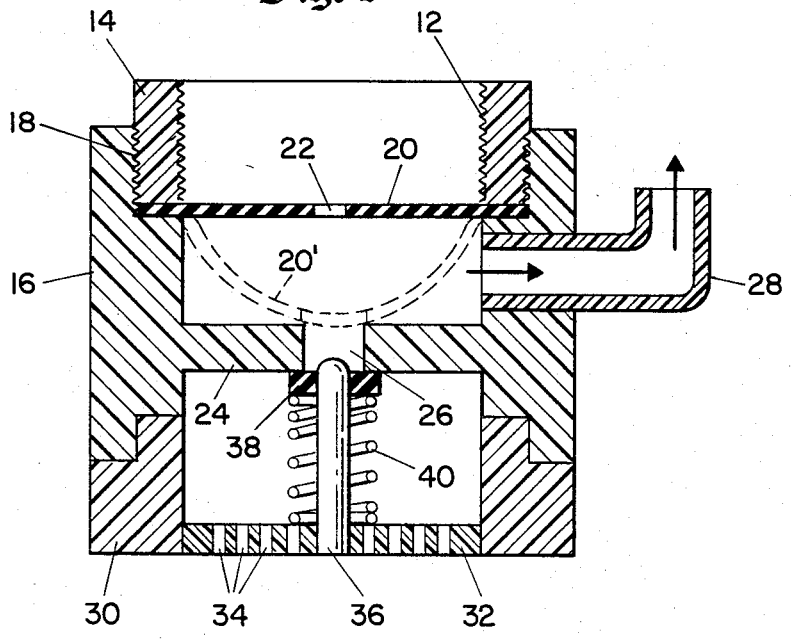
FIG. 1 is a cross sectional view through a drinking fountain attachment assembly for use with a faucet, illustrating the principals of the present invention.
Figure 2:
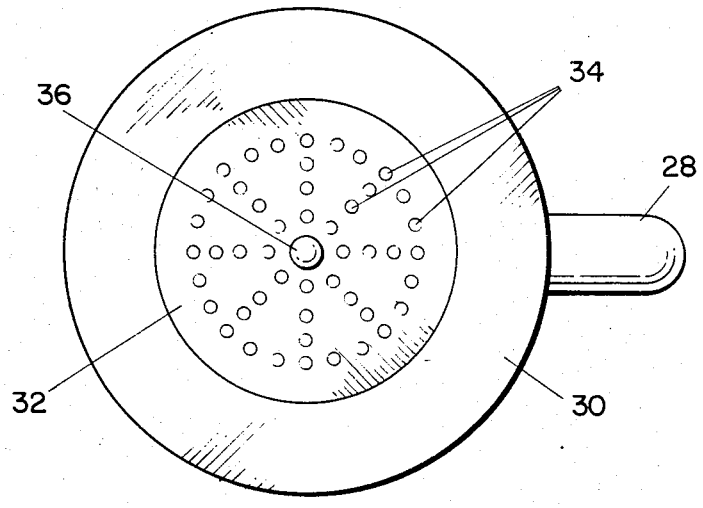
FIG. 2 is a bottom view of the assembly of FIG. 1.

Referring more particulary to the drawings, FIG. 1 shows a drinking fountain assembly for attachement by the threads 12 in the upper member 14 to the external threads which are normally present on a water faucet in a kitchen or bathroom of a home, for example, and to which a metal screen is normally attached. The main body portion 16 of the assembly includes internal threads 18 by which the inlet member 14 is secured to the assembly and also clamps the resilient washer or membrane 20 in place. Incidentally, the resilient washer or membrane 20 is provided with a central opening 22 through which the water from the faucet is supplied. The main body member 16 is hollow and has a partition 24 extending susbstantially across the hollow central portion thereof, with the exception of a central opening 26 through which the water flows.

The water fountain is in the form of a simple L-shaped plastic tube 28, connected through the body member 16 to a point between the central partition 24 and the resilient washer or membrane 20.

The peripheral outlet member 30 is provided with a screen 32 which serves the purpose of the usual metal screen provided conventionally with faucets. The screen 32 is provided with a large number of openings 34 which may be drilled through the circular plastic disc 32.

A poppet valve assembly including a central shaft 36, a rubber washer 38 and a spring 40, is mounted on the plastic screen member 32. The spring 40 normally biases the washer 38 into sealing engagement with the partition 24 to block the flow of water through the central opening 26.

Incidentally, the dash lines 20' indicate the deflected position of the resilient washer for membrane 20 when full pressure is applied to the faucet. When water flow is initiated through the faucet by a main hand-operated valve (not shown), the water flows at relatively low pressures and flow rates to the drinking fountain attachment 28 where it is at the proper pressure and flow rate for easy drinking. As the water pressure and flow rate are increased by further actuation of the main control valve to the faucet, at a certain point both the resilient membrane 20 and the poppet valve washer 38 will shift in their positions, to close off the fountain and to open the straight-through passage from the inlet to the outlet of the assembly. As mentioned above, the deflected position of the resilient washer is shown by the dashed lines 20', and the poppet valve washer 38 slides down on the central shaft 36, with the spring 40 being somewhat compressed. In practice, the spring constant of the spring 40 and the flexibility of the resilient washer or membrane 20 are selected to provide flow switching action at a point where further pressure would otherwise cause excessive spurting from the fountain, and at a flow level somewhat below the levels for normal usage of the water faucet in the bathroom or kitchen.

It is to be understood that the foregoing description and the embodiment shown in the drawings are illustrative of a preferred embodiment of the invention. However, the principles of the present invention may be implemented by alternative arrangements by those skilled in the art. For example, an additional poppet valve, normally open, could be provided in the drinking fountain channel in place of the deflectable resilient washer or membrane 20. If desired, aeration openings may be provided through the lower portion of the housing 16 or the cylindrical member 30. A metallic screen could be employed in place of the apertured plastic disc 32. Further, the central opening 26 could be made somewhat larger than shown in the drawings, to provide increased maximum flow.

Also, if desired, the resilient member could be left out; the hole 26 would then preferably be somewhat larger, with a corresponding increase in the poppet valve (38, 40) structure diameter, so that when it opens, the pressure in the upper chamber above member 24 is reduced so that water does not flow out of the upwardly extending drinking fountain duct 28. Also, in order to fit various faucet threads, the inlet to the unit of the invention could be a rubber sleeve, or several alternate thickness rubber sleeves may be provided to accomoodate any existing faucet threads.

The working model which has been constructed was made of plastic, with a diameter for the element 16 of approximately 2" and of a height from inlet to outlet, which is also approximately 2". The present invention is, of course, not limited to such dimensions, and the unit could be formed of metal, such as stainless steel, instead of plastic. Accordingly, the present invention is not limited to the construction precisely as shown in the accompanying drawings and described in the foregoing detailed description.

What is claimed is:

1. An automatic drinking fountain and faucet assembly comprising:

a hollow housing;

inlet means for supplying water to said housing at one end thereof;

a drinking fountain outlet connected to said housing at a central portion thereof;

an outlet screen connected to said housing at the other end thereof;

a partition extending substantially across the open center of said housing between said screen and the central portion of said housing, said partition having a central passage through the partition;

first valve means for normally closing said central passage, and for opening said passage when the water pressure exceeds a predetermined level;

second valve means for selectively permitting the flow of water from said water supply means to said fountain when the incoming water flows out of the fountain at low water flow and pressure levels, and for blocking water flow to the fountain as the water pressure and flow level are increased.

2. An assembly as defined in claim 1, wherein said first valve means is a poppet valve including a resilient washer mounted to normally close said central passageway and spring means for biasing said washer into sealing engagement over said passageway on the outlet side of said unit.

3. An assembly, as defined in claim 1, wherein said second valve means includes a resilient washer or membrane having a central aperture mounted generally concentrically with said hollow housing between the drinking fountain and the inlet to said housing.

4. An assembly as defined in claim 1 including means for operating said first and second valve means at substantially the same pressure and flow levels.

5. A self-actuating drinking fountain attachment for a faucet comprising:

a hollow housing having an inlet and an outlet;

a drinking fountain;

a partition extending substantially across the open center of said housing, said partition having a passageway through the partition;

means for supplying water from said housing to said fountain, from a point between said partition and the inlet to said housing;

first normally open valve means between said housing inlet and said fountain water supplying means for permitting the flow of water to said drinking fountain at low pressure and flow levels, and for closing said faucet water supply means at predetermined elevated pressure and flow levels;

additional normally close valve means for sealing said central passageway at low pressure and flow levels and for opening said passageway at higher pressure and flow levels.

6. An attachment as defined in claim 5 wherein second valve means is a poppet valve including a resilient member mounted to normally close said passageway and spring means for biasing said washer into sealing engagement over said passageway on the outlet side of said unit.

7. An attachment, as defined in claim 5, wherein said first valve means includes a resilient washer or membrane having a central aperture mounted generally concentrically with said hollow housing between the drinking fountain outlet and the inlet to said housing.

8. An attachment, as defined in claim 5, wherein plastic disc with a substantial plurality of apertures therethrough is mounted at the outlet from said housing.

9. An attachment, as defined in claim 8, wherein said second normally closed valve means includes a shaft mounted on said plastic disc, a resilient washer mounted on said shaft, and coil spring means mounted on said shaft and engaging said washer to bias said washer into engagement with said passageway.

10. A self actuating drinking fountain attachment for a faucet comprising:

a hollow housing having an inlet and an outlet;

a drinking fountain;

water supply means connected between said housing and said fountain;

normally closed valve means located between said fountain and said outlet for closing the outlet from said housing at low pressure and flow levels and for opening said outlet at higher pressure and flow levels;

a partition extending across the housing within the housing between said water supply means and said outlet, said partition having at least one water flow opening through it, and wherein said valve means normally closes said opening;

an additional normally open valve means located between said inlet and said drinking fountain; and said additional valve means including a resilient washer or membrane having at least one aperture aligned with said opening in said partition, and said membrane being mounted generally concentrically with said hollow housing between the drinking fountain and the inlet to said housing to deflect into engagement with said partition, to close off said water supply means.

* * * * *